US006536251B2

(12) United States Patent
Marando et al.

(10) Patent No.: US 6,536,251 B2
(45) Date of Patent: Mar. 25, 2003

(54) APPARATUS FOR PERFORMING HYDROFORMING OPERATION

(75) Inventors: Richard A. Marando, Mohrsville, PA (US); Eric M. Schrack, Shartlesville, PA (US); Jeffrey P. Dziki, Sewickley, PA (US); Joseph J. Vasalani, McKees Rocks, PA (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/822,806

(22) Filed: Mar. 30, 2001

(65) Prior Publication Data

US 2002/0083749 A1 Jul. 4, 2002

Related U.S. Application Data

(60) Provisional application No. 60/539,364, filed on Mar. 31, 2000.

(51) Int. Cl.[7] ..... B21D 26/02
(52) U.S. Cl. ..... 72/61; 72/455
(58) Field of Search ..... 72/61, 455; 100/231

(56) References Cited

U.S. PATENT DOCUMENTS

| | | | | |
|---|---|---|---|---|
| 3,247,783 A | | 4/1966 | Hammon | |
| 4,018,150 A | * | 4/1977 | Shiokawa | 100/231 |
| 5,233,854 A | | 8/1993 | Bowman et al. | |
| 5,481,892 A | | 1/1996 | Roper et al. | |
| 5,482,454 A | | 1/1996 | Miyahara et al. | |
| 5,568,742 A | | 10/1996 | Bauer | |
| 5,600,983 A | | 2/1997 | Rigsby | |
| 5,735,156 A | | 4/1998 | Yoshitomi et al. | |
| 6,018,971 A | | 2/2000 | Kleinschmidt | |

FOREIGN PATENT DOCUMENTS

| | | |
|---|---|---|
| DE | 2528153 | 3/1977 |
| EP | 686440 | 12/1995 |
| FR | 1595056 | 6/1970 |
| GB | 1318183 | 5/1973 |

* cited by examiner

*Primary Examiner*—Lowell A. Larson
(74) *Attorney, Agent, or Firm*—MacMillan, Sobanski & Todd, LLC

(57) ABSTRACT

A hydroforming apparatus includes an upper platen carrying an upper die section and a lower platen carrying a lower die section. The platens are connected together by tie rods extending through respective compression tubes. The upper and lower die sections have recessed areas formed therein that define a die cavity. When the lower die section is moved to a lowered position, a workpiece can be disposed in the recessed area formed therein. Then, the lower die section and the workpiece are elevated by cylinders such that the workpiece is enclosed within the die cavity and mechanically deformed by the cooperated upper and lower die sections. A support block is then moved between the hydroforming die and the lower platen. A cylinder array containing a plurality of pistons is next hydraulically actuated so as to securely clamp the hydroforming die between the cylinder array and the lower platen. While the cylinder array is actuated, pressurized fluid is supplied within the workpiece, deforming it into conformance with the die cavity.

30 Claims, 11 Drawing Sheets

APPARATUS FOR PERFORMING HYDROFORMING OPERATION

CROSS REFERENCE TO RELATED APPLICATION

This application claims the benefit of U.S. Provisional Application No. 09/539,364, filed Mar. 31, 2000.

BACKGROUND OF THE INVENTION

This invention relates in general to an apparatus for performing a hydroforming operation on a closed channel workpiece. In particular, this invention relates to an improved structure for such a hydroforming apparatus that is relative simple and inexpensive in structure and operation and is well suited for performing a hydroforming operation on relatively long workpieces, such as side rails for a vehicle frame assembly.

Hydroforming is a well known metal working process that uses pressurized fluid to deform a closed channel workpiece, such as a tubular member, outwardly into conformance with a die cavity having a desired shape. A typical hydroforming apparatus includes a frame having a two or more die sections that are supported thereon for relative movement between opened and closed positions. The die sections have cooperating recesses formed therein that together define a die cavity having a shape corresponding to a desired final shape for the workpiece. When moved to the opened position, the die sections are spaced apart from one another to allow a workpiece to be inserted within or removed from the die cavity. When moved to the closed position, the die sections are disposed adjacent to one another so as to enclose the workpiece within the die cavity. Although the die cavity is usually somewhat larger than the workpiece to be hydroformed, movement of the two die sections from the opened position to the closed position may, in some instances, cause some mechanical deformation of the hollow member. In any event, the workpiece is then filled with a fluid, typically a relatively incompressible liquid such as water. The pressure of the fluid within the workpiece is increased to such a magnitude that the workpiece is expanded outwardly into conformance with the die cavity. As a result, the workpiece is deformed or expanded into the desired final shape. Hydroforming is an advantageous process for forming vehicle frame components and other structures because it can quickly deform a workpiece into a desired complex shape.

In a typical hydroforming apparatus, the die sections are arranged such that an upper die section is supported on a ram of the apparatus, while a lower die section is supported on a bed of the apparatus. A mechanical or hydraulic actuator is provided for raising the ram and the upper die section upwardly to the opened position relative to the lower die section, allowing the previously deformed workpiece to be removed from and the new workpiece to be inserted within the die cavity. The actuator also lowers the ram and the upper die section downwardly to the closed position relative to the lower die section, allowing the hydroforming process to be performed. To maintain the die sections together during the hydroforming process, a mechanical clamping device is usually provided. The mechanical clamping device mechanically engages the die sections (or, alternatively, the ram and the base upon which the die sections are supported) to prevent them from moving apart from one another. during the hydroforming process. Such movement would obviously be undesirable because the shape of the die cavity would become distorted, resulting in unacceptable variations in the final shape of the workpiece.

As mentioned above, the hydroforming process involves the application of a highly pressurized fluid within the workpiece to cause expansion thereof. The magnitude of the pressure of the fluid within the workpiece will vary according to many factors, one of which being the physical size of the workpiece to be deformed. When a relatively small or thin-walled workpiece is being deformed, the magnitude of the pressure of the fluid supplied within the workpiece during the hydroforming operation is relatively small. Accordingly, the amount of the outwardly-directed force exerted by the workpiece on the die sections during the hydroforming operation is also relatively small. In these instances, only a relatively small amount of inwardly-directed force is required to be exerted by the hydroforming apparatus to counteract the outwardly-directed force so as to maintain the die sections in the closed position during the hydroforming operation. Consequently, the physical size and strength of the hydroforming apparatus when used for deforming relatively small or thin-walled workpieces is no greater than a typical mechanical press for performing a similar operation.

However, when a relatively large or thick-walled workpiece is being deformed (such as is found in many vehicle frame components, including side rails, cross members, and the like), the magnitude of the pressure of the fluid supplied within the workpiece during the hydroforming operation is relatively large. Accordingly, the amount of the outwardly-directed force exerted by the workpiece on the die sections during the hydroforming operation is also relatively large. To counteract this, a relatively large amount of inwardly-directed force is required to be exerted by the hydroforming apparatus to maintain the die sections in the closed position during the hydroforming operation. Consequently, the physical size and strength of the hydroforming apparatus is as large or larger than a typical mechanical press for performing a similar operation. This is particularly troublesome when the workpiece is relatively long, such as found in side rails for vehicle frames. The cost and complexity of manufacturing a conventional hydroforming apparatus that is capable of deforming such a workpiece is very high. Thus, it would be desirable to provide an improved structure for a hydroforming apparatus that is capable of deforming relatively large and thick-walled workpieces, yet which is relatively small, simple, and inexpensive in construction and operation.

SUMMARY OF THE INVENTION

This invention relates to an improved structure for a hydroforming apparatus that is capable of deforming relatively large and thick-walled workpieces, yet which is relatively small, simple, and inexpensive in construction and operation. The hydroforming apparatus includes an upper platen and a lower platen that are connected together by tie rods extending through respective compression tubes. An upper die section is supported on the upper platen, while a lower die section is supported on the lower platen for vertical movement relative to the upper die section. The upper and lower die sections have respective recessed areas formed therein that define a hydroforming die cavity. When the lower die section is moved to a lowered position, a workpiece can be disposed in the recessed area formed therein. Then, the lower die section and the workpiece are elevated by cylinders such that the workpiece is enclosed within the hydroforming cavity and mechanically deformed by the cooperated upper and lower die sections. A hydroforming support block is then moved between the hydroforming die and the lower platen. A cylinder array containing a plurality of pistons is next hydraulically actuated so as to securely clamp the hydroforming die between the cylinder array and the support block. While the cylinder array is actuated, pressurized fluid is supplied within the workpiece, causing it to deform into conformance with the hydroforming die cavity.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
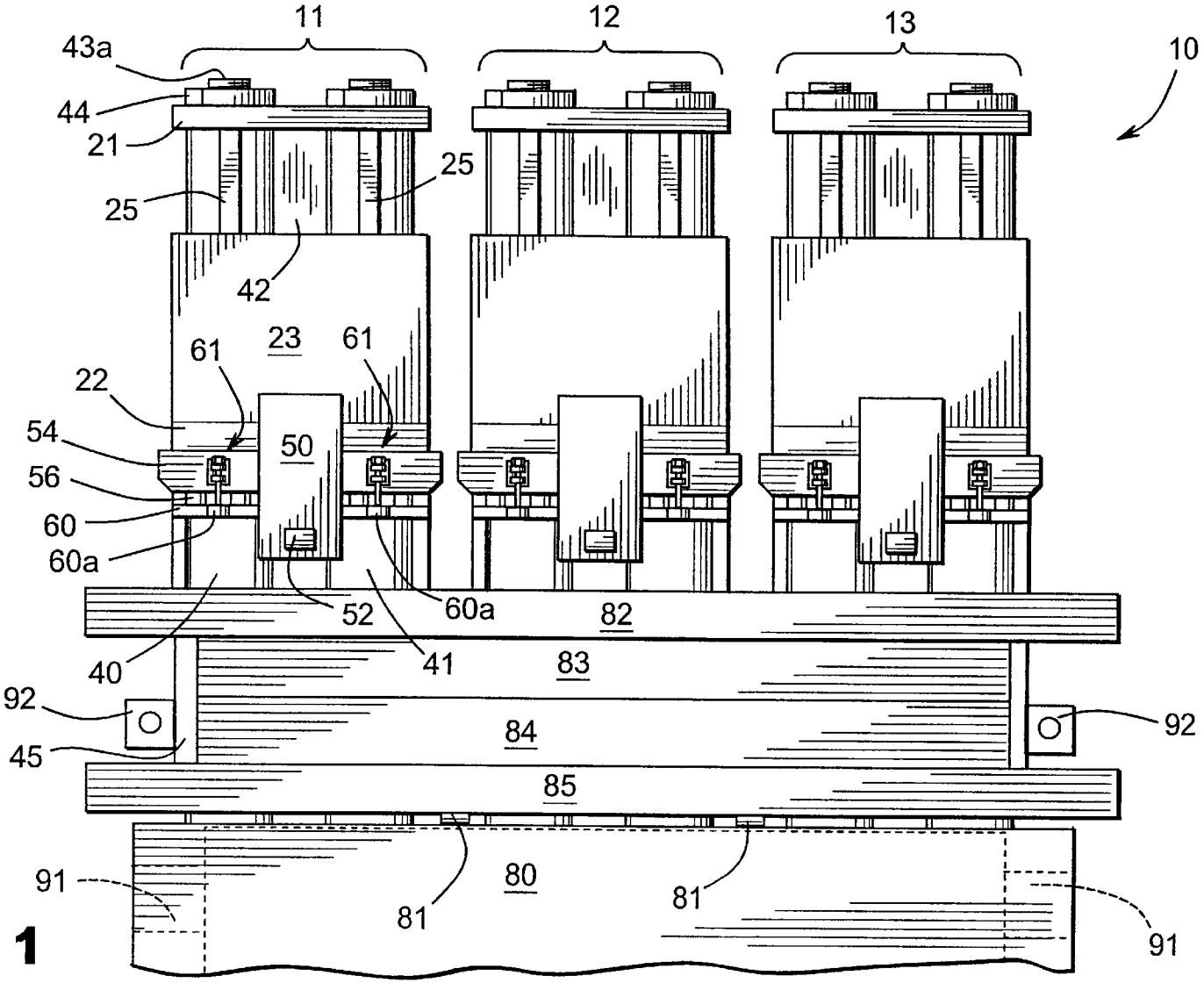
FIG. 1 is a front elevational view of a portion of a hydroforming apparatus in accordance with this invention.
Figure 2:
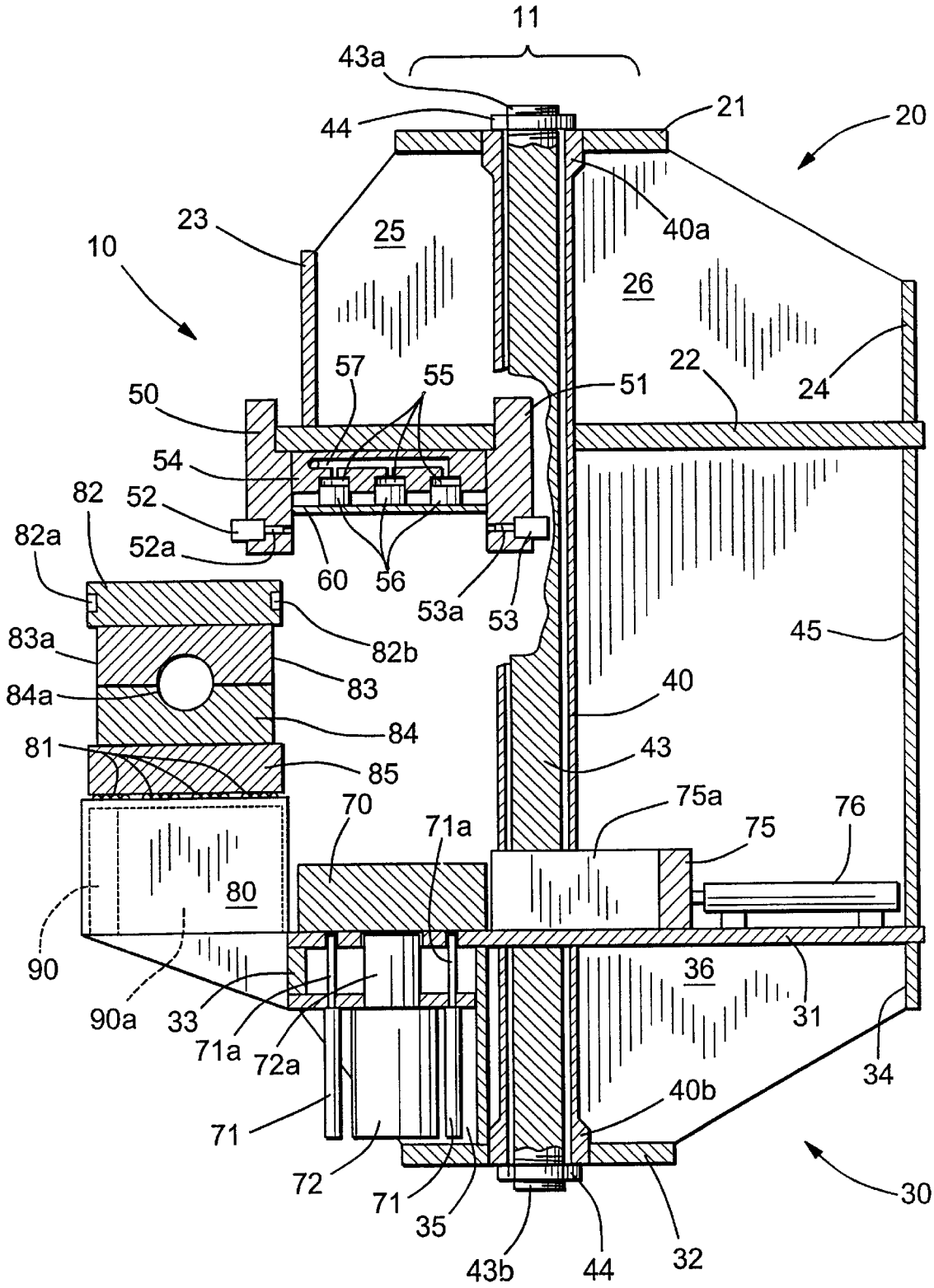
FIG. 2 is a sectional elevational view, partially broken away, of the hydroforming apparatus illustrated in FIG. 1 showing the components thereof prior to the installation of a hydroforming die within the hydroforming apparatus.

Referring now to the drawings, there is illustrated in FIGS. 1 and 2 a hydroforming apparatus, indicated generally at 10, in accordance with this invention. The illustrated hydroforming apparatus 10 is of generally modular construction, including three hydroforming modules indicated at 11, 12, and 13. The modules 11, 12, and 13 are generally identical in structure and operation and can be arranged in side-by-side manner. Although three of such hydroforming modules 11, 12, and 13 are shown, it will be appreciated that the hydroforming apparatus 10 may be formed having a greater or lesser number of such modules 11, 12, and 13. Alternatively, the hydroforming apparatus 10 need not be formed having such a modular construction.

Each of the modules 11, 12, and 13 of the hydroforming apparatus 10 includes an upper platen, indicated generally at 20. The illustrated upper platen 20 is generally box-shaped in construction, including an upper horizontally extending structural plate 21, a lower horizontally extending structural plate 22, a front vertically extending. structural plate 23, and a rear vertically extending structural plate 24. The structural plates 21, 22, 23, and 24 are connected to one another in any conventional manner, such as by welding. A first pair of laterally extending front reinforcement plates 25 and a second pair of laterally extending rear reinforcement plates 26 (only one is illustrated) can be connected to the structural plates 21, 22, 23, and 24 in any conventional manner, such as by welding, to increase the overall strength and rigidity of the upper platen 20.

Each of the modules 11, 12, and 13 of the hydroforming apparatus 10 also includes a lower platen, indicated generally at 30. The illustrated lower platen 30 is also generally box-shaped in construction, including an upper horizontally extending structural plate 31, a lower horizontally extending structural plate 32, a front vertically extending structural plate 33, and a rear vertically extending structural plate 34. The structural plates 31, 32, 33, and 34 are connected to one another in any conventional manner, such as by welding. A first pair of laterally extending front reinforcement plates 35 (only one is illustrated) and a second pair of laterally extending rear reinforcement plates 36 (only one is illustrated) can be connected to the structural plates 21, 22, 23, and 24 in any conventional manner, such as by welding, to increase the overall strength and rigidity of the lower platen 30.

The upper platen 20 and the lower platen 30 are connected together by a pair of vertically extending compression tubes or members 40 and 41. The illustrated compression tubes 40 and 41 are generally hollow and cylindrical in shape and are preferably formed having upper and lower ends 40*a* and 40*b* (see FIG. 2) of increased wall thickness. The compression tubes 40 and 41 are secured to one or more portions of both the upper platen 20 and the lower platen 30 in any conventional manner, such as by welding. If desired, a transversely extending supporting plate 42 (see FIG. 1) may be connected between the compression tubes 40 and 41 in any conventional manner, such as by welding, to increase the overall strength and rigidity of the compression tubes 40 and 41 and the hydroforming apparatus 10 as a whole.

A tie rod 43 extends through each of the compression tubes 40 and 41 from the upper platen 20 to the lower platen 30. Each of the tie rods 43 is a generally solid cylindrical member having an upper end portion 43*a* that extends above the upper horizontally extending structural plate 21 of the upper platen 20 and a lower end portion 43*b* that extends below the lower horizontally extending structural plate 32 of the lower platen 30. In the illustrated embodiment, the upper and lower end portions 43*a* and 43*b* of the tie rod 43 are threaded, and nuts 44 or similar retaining devices are threaded onto such threaded end portions 43*a* and 43*b* to connect the tie rods 43 to the compression tubes 41. When tightened, the nuts 44 are drawn into engagement with the upper horizontally extending structural plate 21 of the upper platen 20 and the lower horizontally extending structural plate 32 of the lower platen 30, as well as the upper and lower end portions 40*a* and 40*b* of the compression tubes 40. As a result, the compression tubes 40 are pre-stressed with compressive forces, for a purpose that will be explained below. If desired, structures other than the illustrated threaded end portions 43*a* and 43*b* and nuts 44 may be used for accomplishing these purposes. A backing plate 45 extends between the lower horizontally extending structural plate 22 of the upper platen 20 and the upper horizontally extending structural plate 31 of the lower platen 30 for a purpose that will also be explained below.

A pair of upper die clamping assemblies 50 and 51 are provided on the upper platen 20. In the illustrated embodiment, the upper die clamping assemblies 50 and 51 are secured to the lower horizontally extending structural plate 22 of the upper platen 20 in any conventional manner, such as by welding. The upper die clamping assemblies 50 and 51 have respective die locking cylinders 52 and 53 supported thereon. The die locking cylinders 52 and 53 include respective locking pins 52*a* and 53*a* that are selectively movable between retracted and extended positions. Preferably, the die locking cylinders 52 and 53 are hydraulically actuated, although such is not required. The purpose for the upper die clamping assemblies 50 and 51 will be explained below.

A cylinder array 54 is also provided on the upper platen 20. In the illustrated embodiment, the cylinder array 54 is secured to the lower horizontally extending structural plate 22 of the upper platen 20 in any conventional manner, such as by welding, and extends laterally between upper die clamping assemblies 50 and 51. The cylinder array 54 has a plurality of hollow cylinders 55 formed in the lower surface thereof. The quantity and location of such hollow cylinders 55 may be determined as necessary to perform the hydroforming operation described below. A piston 56 is disposed in each of the hollow cylinders 55 for limited upward and downward movement in the manner described below. A plurality of passageways 57 are formed through the cylinder array 54 such that the hollow cylinders 55 are in fluid communication with one another. The passageways 57 selectively communicate with a source of pressurized fluid (not shown). The purpose for the cylinder array 54 and the pistons 56 will be explained below.

Figure 3:
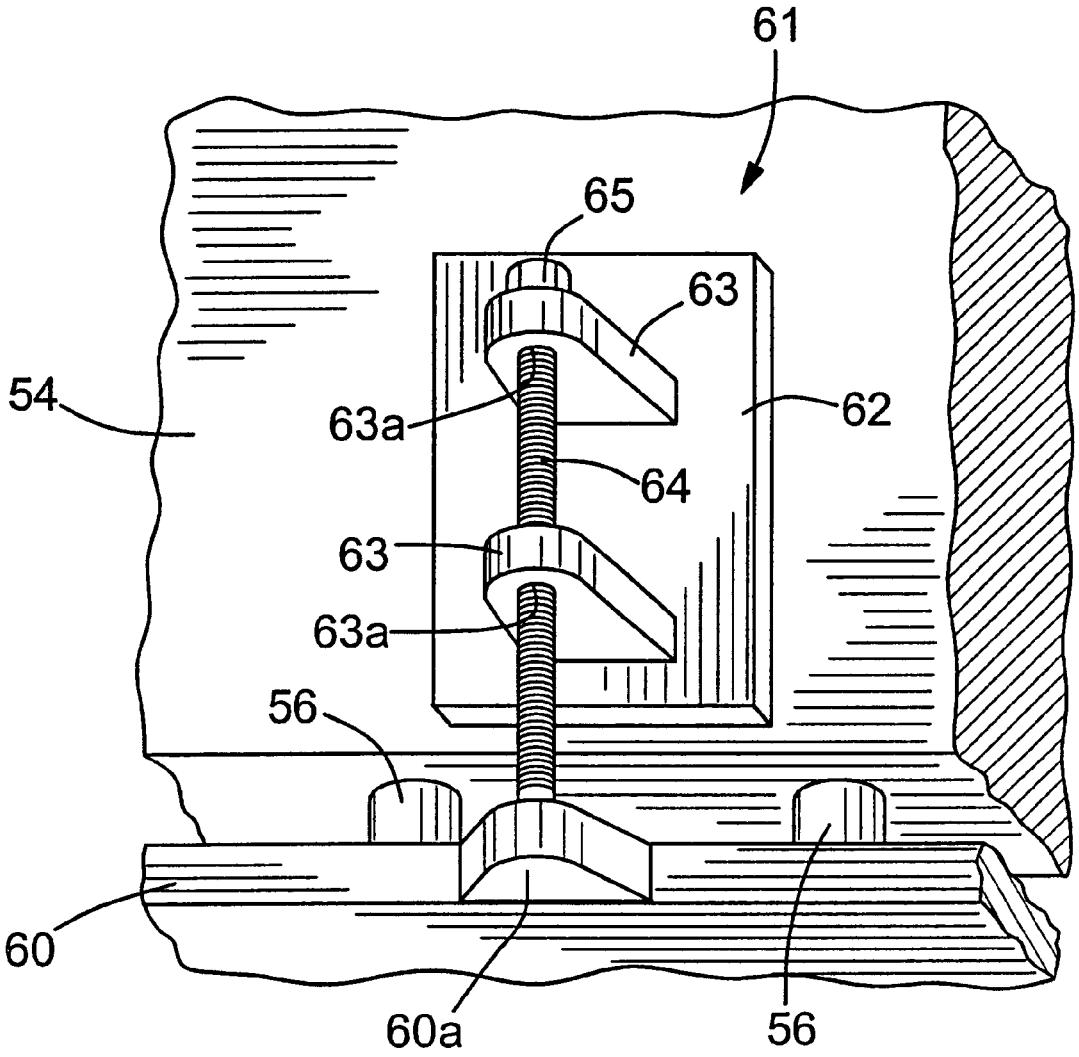
FIG. 3 is an enlarged perspective view, partially broken away, of a portion of the hydroforming apparatus illustrated in FIGS. 1 and 2.

A retainer plate 60 is provided on the cylinder array 54 for retaining the pistons 56 within the cylinders 55. The retainer plate 60 is supported on the cylinder array 54 for limited upward and downward movement by a plurality of support assemblies, indicated generally at 61. In the illustrated embodiment, a first pair of support assemblies 61 are provided on the front side of the cylinder array 54, and a second pair of support assemblies (not shown) are provided on the rear side of the cylinder array 54. However, any number of such support assemblies 61 may be provided at any desired locations. The structure of one of the support assemblies 61 is illustrated in detail in FIG. 3. As shown therein, the support assembly 61 includes a backing plate 62 having a pair of upstanding ears 63 formed thereon or secured thereto. Each of the ears 63 has an opening 63*a* formed therethrough, and the openings 63*a* are vertically aligned with one another. A rod 64 extends through the aligned openings 63*a* formed through the ears 63 for vertical sliding movement relative thereto. The rod 64 has a lower end that is secured to a lug 60*a* formed on or secured to the retainer plate 60 for movement therewith. The rod 64 further has an upper end that has an enlarged nut 65 or other retaining device formed thereon or secured thereto. The nut 65 is larger in size than the openings 63*a* formed through the ears 63. Thus, the retainer plate 60 and the rods 64 can move upwardly and downwardly relative to the cylinder array 54 between an uppermost position, wherein the retainer plate 60 abuts the cylinder array 54, and a lowermost position, wherein the nut 65 engages the upper surface of the upper ear 63. The purpose for this limited relative movement will be explained below.

A crosshead 70 is supported on the upper horizontally extending structural plate 31 of the lower platen 30. The crosshead 70 is supported for limited vertical movement relative to the upper horizontally extending structural plate 31 by one or more lift cylinders 71 (two of which are illustrated in FIG. 2) and one or more crush cylinders 72 (one of which is illustrated in FIG. 2). The lift cylinders 71 are secured to the upper horizontally extending structural plate 31 or are otherwise supported on the lower platen 30. Each of the lift cylinders 71 has a piston 71*a* that extends upwardly therefrom through an opening formed through the upper horizontally extending structural plate 31 and is adapted to engage the lower surface of the crosshead 70. The lift cylinders 71 are preferably relatively small in size so as to selectively effect relatively high velocity, low force exertion movement of the pistons 71*a* and the crosshead 70. The lift cylinders 71 are preferably hydraulically actuated, although such is not necessary. The crush cylinders 72 are also secured to the upper horizontally extending structural plate 31 or are otherwise supported on the lower platen 30. Each of the crush cylinders 72 has a piston 72*a* that extends upwardly therefrom through an opening formed through the upper horizontally extending structural plate 31 and is adapted to engage the lower surface of the crosshead 70. The crush cylinders 72 are preferably relatively large in size so as to selectively effect relatively low velocity, high force exertion movement of the pistons 71*a* and the crosshead 70. The crush cylinders 72 are also preferably hydraulically actuated, although such is not necessary. The quantity and location of such lift cylinders 71 and crush cylinders 72 may be determined as necessary to perform the hydroforming operation described below.

A die change spacer block 75 is supported on the upper horizontally extending structural plate 31 of the lower platen 30. The die change spacer block 75 is supported for limited horizontal movement relative to the upper horizontally extending structural plate 31 by one or more spacer block cylinders 76 that may be supported on the upper horizontally extending structural plate 31 of the lower platen 30. Thus, the die change spacer block 75 can be moved between a retracted position (illustrated in FIG. 2) and an extended position by the spacer block cylinders 76. One or more slots 75*a* are formed in the die change spacer block 75. The purpose for the die change spacer block 75 and the slots 75*a* will be explained below.

A hollow die transfer housing 80 is connected to the upper horizontally extending structural plate 31 or otherwise supported on the lower platen 30. As shown in FIG. 1, the illustrated die transfer housing 80 extends laterally throughout all of the hydroforming modules 11, 12, and 13 of the hydroforming apparatus 10, although such is not necessary. The die transfer housing 80 has a plurality of rollers 81 or other transport mechanisms provided on the upper surface thereof. A hydroforming die, including an upper die mounting plate 82, an upper die section 83, a lower die section 84, and a lower die mounting plate 85, is supported on the rollers 81 of the die transfer housing 80. The upper surface of the upper die section 83 is secured to the upper die mounting plate 82, while the lower surface of the upper die section 83 has a recessed area 83*a* formed therein. Similarly, the lower surface of the lower die section 84 is secured to the lower die mounting plate 85, while the upper surface of the lower die section 84 has a recessed area 84*a* formed therein. When the upper and lower die sections 83 and 84 are moved together, such as shown in FIG. 2, the recessed areas 83*a* and 84*a* cooperate to define a hydroforming cavity that extends transversely throughout the hydroforming die. The upper die mounting plate 82 has recesses 82*a* and 82*b* respectively formed in the front and rear sides thereof. The purpose for these recesses 82*a* and 82*b* will be explained below.

A hydroforming support block 90 is supported within the hollow die transfer housing 80. The hydroforming support block 90 is supported for limited horizontal movement relative to the die transfer housing 80 by one or more support block cylinders 91 that may be provided within the die transfer housing 80 or supported in any other desired location on the hydroforming apparatus 10. Thus, the hydroforming support block 90 can be moved between a retracted position (illustrated in FIG. 2) and an extended position by the support block cylinders 91. One or more slots 90*a* are formed in the hydroforming support block 90. The purpose for the hydroforming support block 90 and the slots 90*a* will be explained below. Referring back to FIG. 1, a pair of die change cylinders 92 are secured to the backing plate 45 or otherwise supported on the hydroforming apparatus 10. The purpose for the die change cylinders 92 will be explained below.

The operation of the hydroforming apparatus 10 will now be described. Initially, the hydroforming die must be installed within the hydroforming apparatus 10. To accomplish this, the various components of the hydroforming apparatus 10 are oriented in the retracted positions illustrated in FIG. 2, and the hydroforming die is disposed on top of the rollers 81 provided on the upper surface of the die transfer housing 80. In this initial arrangement, the passageways 57 formed through the cylinder array 54 do not communicate with the source of pressurized fluid. Thus, although the pistons 56 and the retainer plate 60 depend from the cylinder array 60 under the influence of gravity to the extent permitted by the support assemblies 61, no pressure is exerted thereby.

Figure 4:
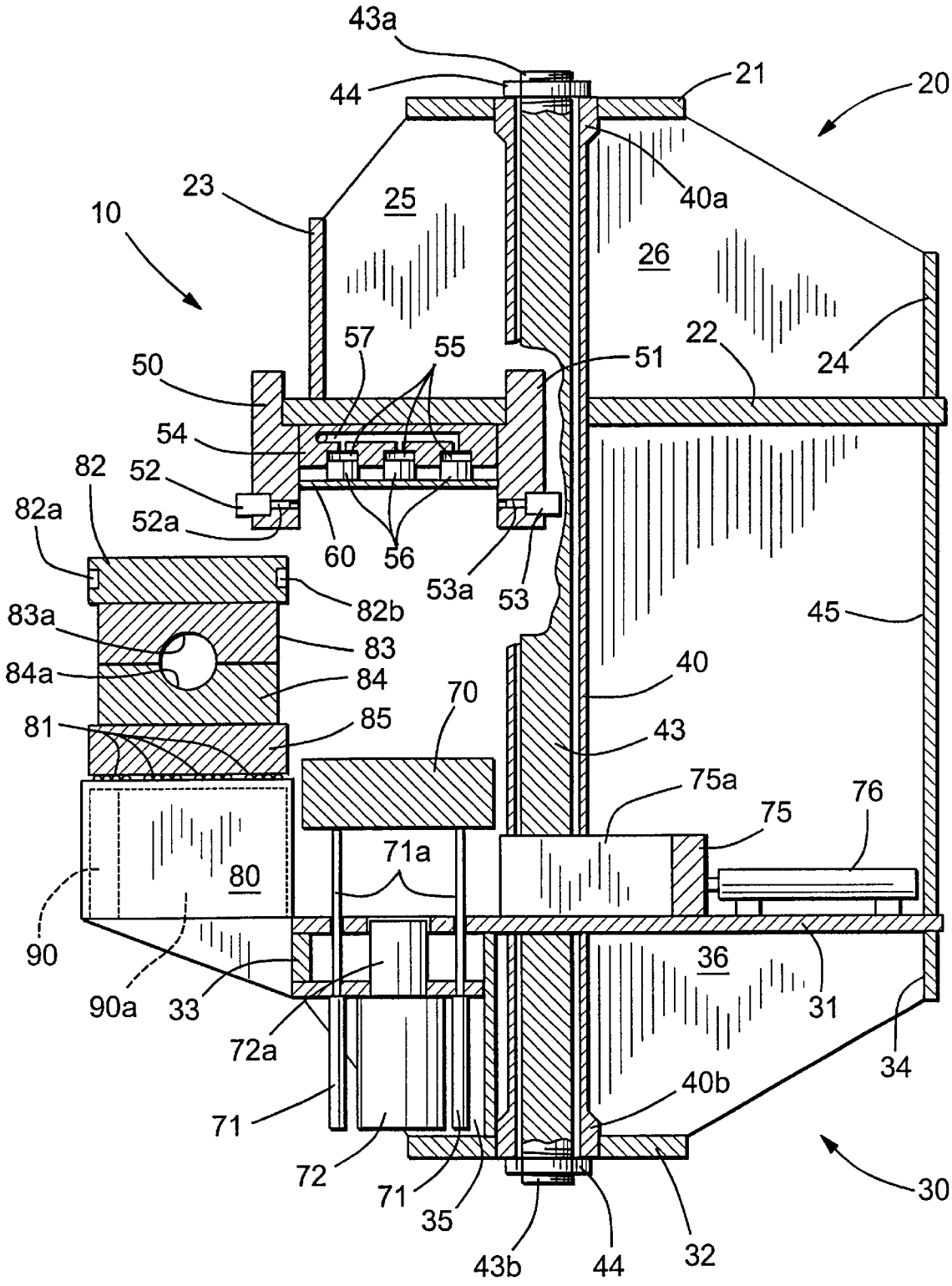
FIG. 4 is a sectional elevational view similar to FIG. 2 showing the crosshead after having been raised to an elevated position by the lift cylinders.

To install the hydroforming die within the hydroforming apparatus 10, the lift cylinders 71 are initially actuated as shown in FIG. 4 to extend the pistons 71*a*, thereby elevating the crosshead 70 to an elevated position. In this elevated position, the upper surface of the crosshead 70 is disposed somewhat higher than the lower surface of the hydroforming die supported on the rollers 81 provided on the upper surface of the die transfer housing 80. At the same time, the lower surface of the crosshead 70 is disposed somewhat higher than the upper surface of the die change spacer block 75.

Figure 5:
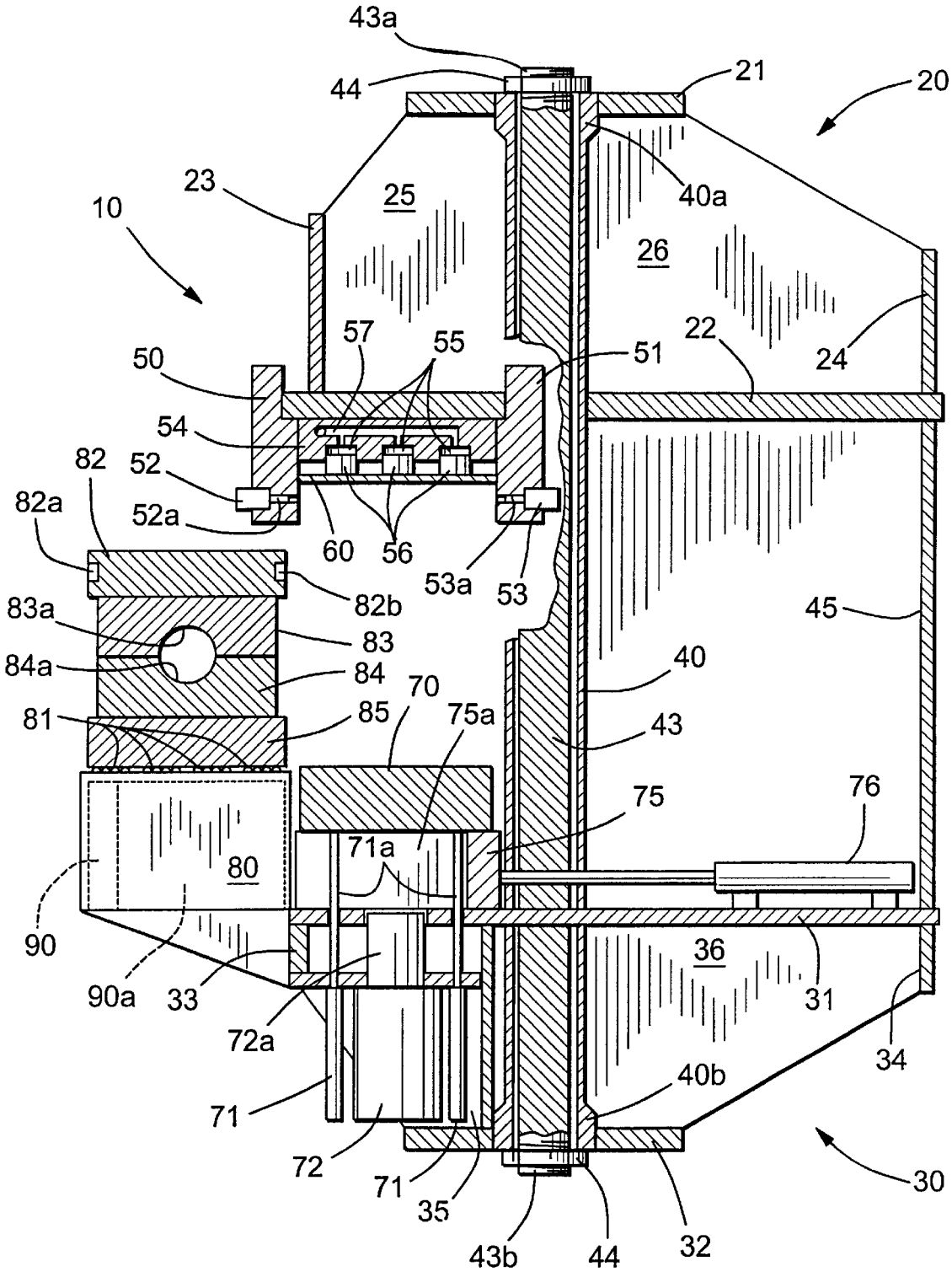
FIG. 5 is a sectional elevational view similar to FIG. 4 showing the die change spacer block after having been moved to an extended position beneath the crosshead by the spacer block cylinders.

Then, as shown in FIG. 5, the spacer block cylinders 76 are actuated to extend the die change spacer block 75 laterally beneath the crosshead 70. As mentioned above, one or more slots 75*a* are formed in the die change spacer block 75. These slots 75*a* are provided to permit this lateral movement of the die change spacer block 75 to occur while the pistons 71*a* of the lift cylinders 71 are extended. Such pistons 71*a* are received within the clearance provided by the slots 75*a* so that no interference with the die change spacer block 75 occurs. Thereafter, the pistons 71*a* of the lift cylinders 71 are retracted such that the crosshead 70 is lowered onto the die change spacer block 75, as also shown in FIG. 5. The crosshead 70 and the die change spacer block 75 are sized such that when the crosshead 70 is lowered onto the die change spacer block 75, the upper surface of the crosshead 70 is precisely flush with the lower surface of the hydroforming die disposed on top of the rollers 81 provided on the upper surface of the die transfer housing 80.

Figure 6:
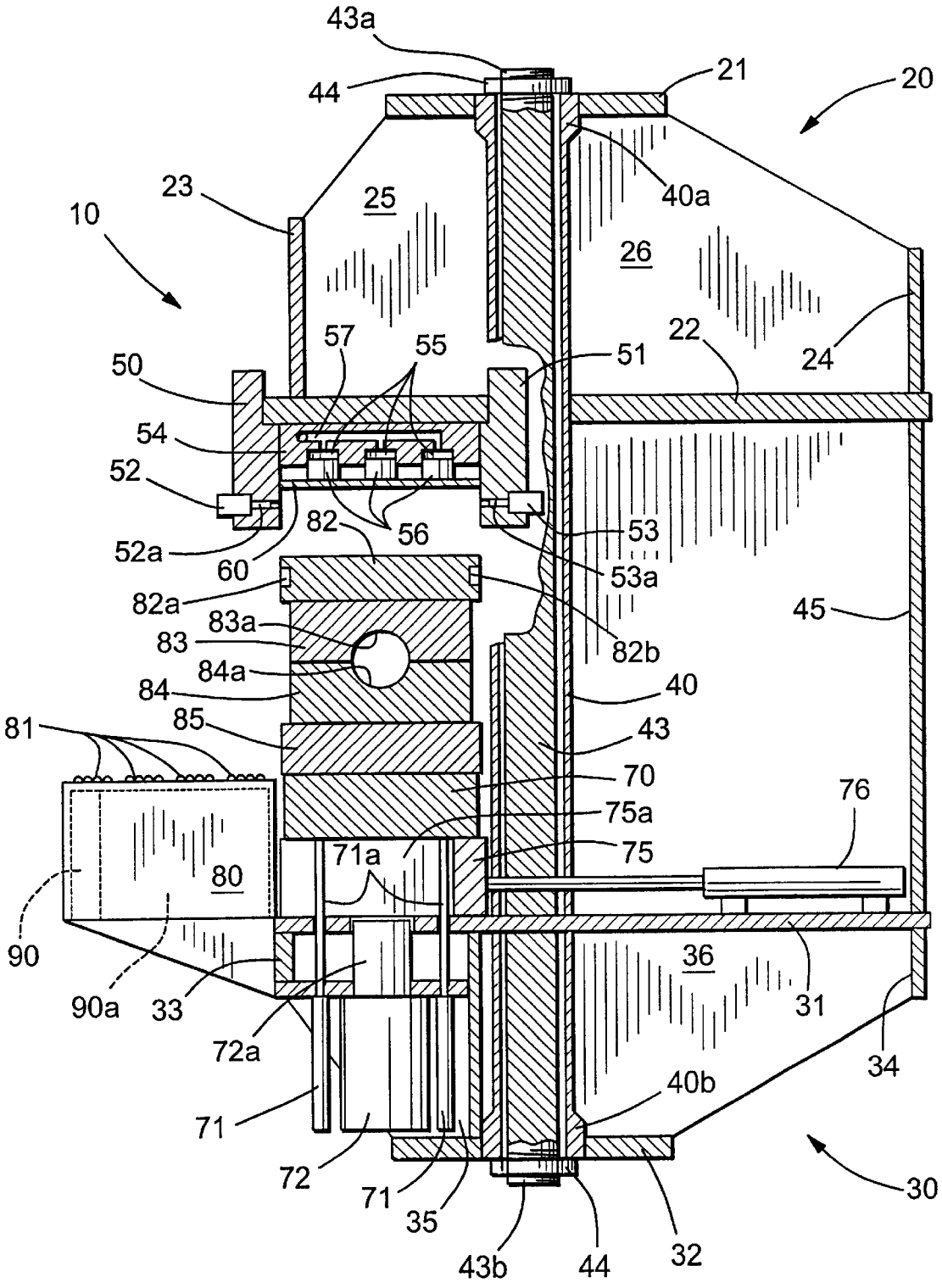
FIG. 6 is a sectional elevational view similar to FIG. 5 showing the crosshead after having been lowered onto the die change spacer block by the lift cylinders, and the hydroforming die after having been moved onto the crosshead by the die change cylinders.

As a result of this flush alignment, the hydroforming die can be moved laterally by the die change cylinders 92 off of the rollers 81 provided on the upper surface of the die transfer housing 80 and onto the upper surface of the crosshead 70, as shown in FIG. 6. This lateral movement of the hydroforming die is accomplished by the die change cylinders 92 that, as mentioned above, are secured to the backing plate 45 or otherwise supported on the hydroforming apparatus 10. The die change cylinders 92 are adapted to engage portions of the lower die mounting plate 85 or other portions of the hydroforming die to selectively effect lateral movement thereof. When so moved, the hydroforming die is vertically aligned between the upper die clamping assemblies 50 and 51 carried on the upper platen 20.

Figure 7:
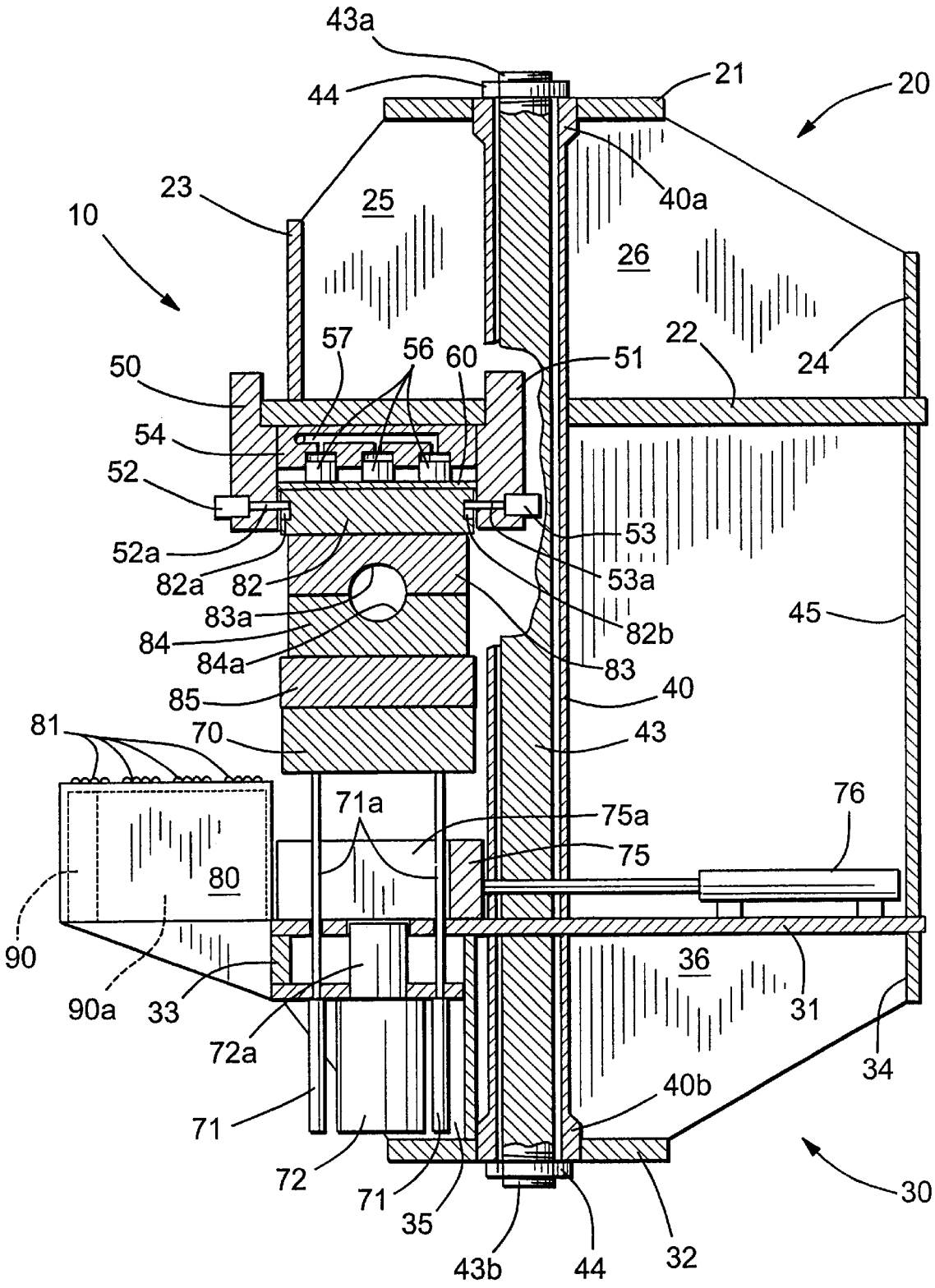
FIG. 7 is a sectional elevational view similar to FIG. 6 showing the crosshead and the hydroforming die after having been moved to a further elevated position by the lift cylinders, and the upper die section after having been secured to the upper die clamping assemblies.

Next, the lift cylinders 71 are again actuated as shown in FIG. 7 to extend the pistons 71*a*, thereby elevating the crosshead 70 and the hydroforming die to a further elevated position. In this further elevated position, the upper surface of the upper die mounting plate 82 abuts the lower surface of the retainer plate 60. At the same time, the recesses 82*a* and 82*b* formed in the upper die mounting plate 82 are laterally aligned with the retracted locking pins 52*a* and 53*a* provided on the die locking cylinders 52 and 53, respectively. Then, the die locking cylinders 52 and 53 are actuated to move the locking pins 52*a* and 53*a*, respectively from their retracted positions to the extended positions illustrated in FIG. 7. When this occurs, the locking pins 52*a* and 53*a* are respectively received within the recesses 82*a* and 83*a* formed in the upper die mounting plate 82. Consequently, the upper die mounting plate 82, and the upper die section 83 secured thereto, are positively connected to the upper die clamping assemblies 50 and 51 and, therefore, the upper platen 20. As is apparent in FIG. 7, the recesses 82*a* and 82*b* formed in the upper die mounting plate 82 are somewhat larger in size, at least in the vertical direction, than the locking pins 52*a* and 53*a*. Thus, similar to the retainer plate 60, the upper die mounting plate 82 and the upper die section 83 are supported on the upper die clamping assemblies 50 and 51 for limited upward and downward movement.

Figure 8:
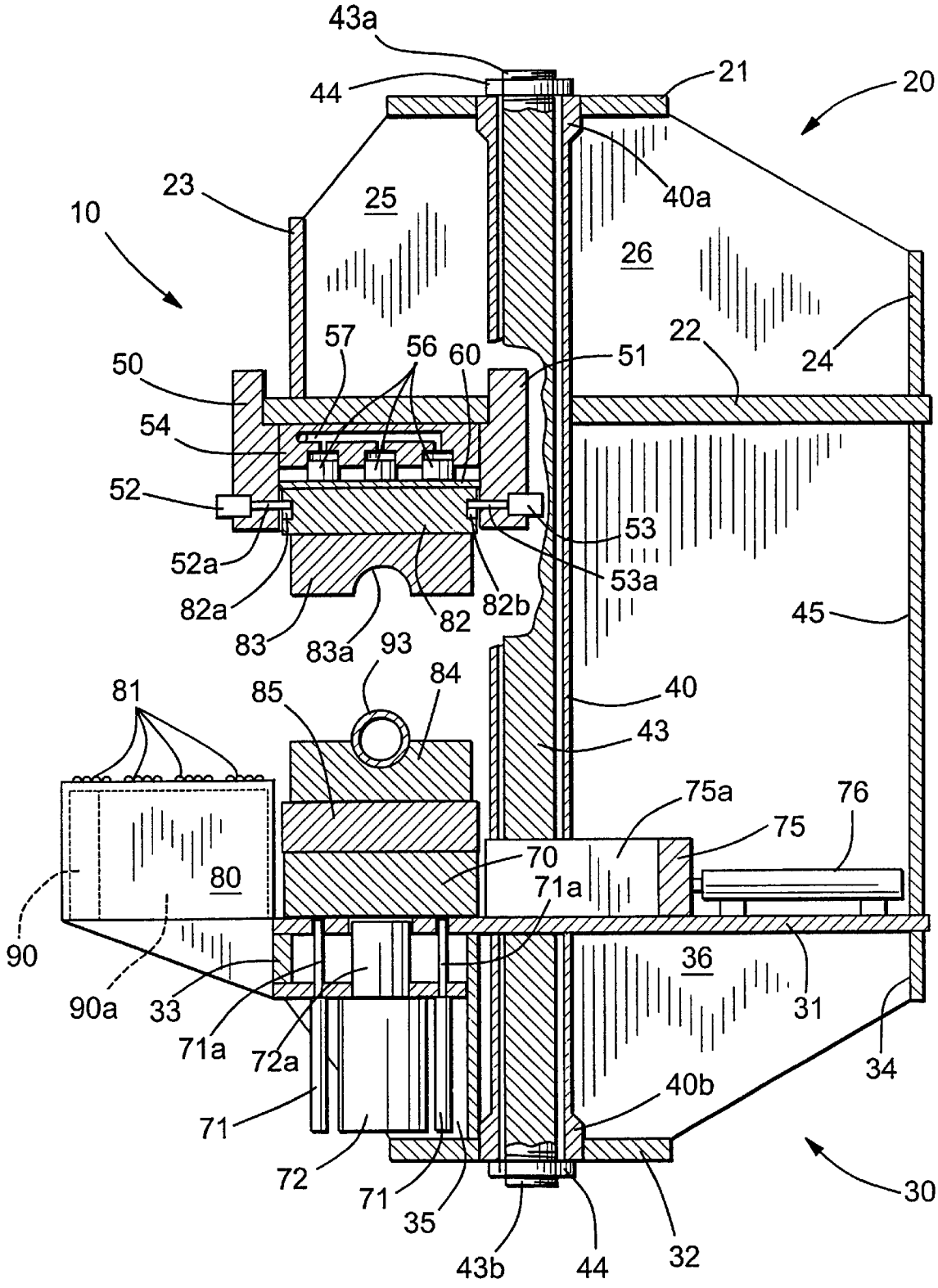
FIG. 8 is a sectional elevational view similar to FIG. 7 showing the die change spacer block after having been moved to a retracted position by the spacer block cylinders, the crosshead and the lower die section after having been lowered relative to the upper die section by the lift cylinders, and a workpiece after having been inserted within the hydroforming die.

The final steps in the die installation process are shown in FIG. 8. Initially, the spacer block cylinders 76 are actuated to retract the die change spacer block 75 laterally from beneath the crosshead 70 to its original position. Then, the pistons 71*a* of the lift cylinders 71 are retracted to lower the lower die section 84, the lower die mounting plate 85, and the crosshead 70 relative to the upper die mounting plate 82 and the upper die section 83, which remain connected to the upper die clamping assemblies 50 and 51 and the upper platen 20. This completes the die installation process for the hydroforming apparatus 10, which is now ready to perform a hydroforming operation.

The initial step in the cycle of the hydroforming operation is also shown in FIG. 8, wherein a workpiece 93 is inserted between the upper and lower die sections 82 and 83, respectively. Because the lower die section 84 has been lowered relative to the upper die section 83, clearance is provided to insert the workpiece 93 therebetween. The workpiece 93 is a closed channel structural member, such as a tubular member, that may be pre-bent in a known manner to achieve a predetermined rough shape for the final hydroformed component. Any conventional mechanism (not shown) can be used to insert the workpiece 93 between the upper die section 83 and the lower die section 84. Typically, the workpiece 93 will be placed within the recessed area 84*a* formed in the lower die section 84. The workpiece 93 is preferably sized such that the ends thereof extend a predetermined distance transversely from each side of the hydroforming die. This is done to facilitate the connection of conventional end feed cylinders (not shown) thereto to perform the hydroforming process, as will be explained in further detail below.

Figure 9:
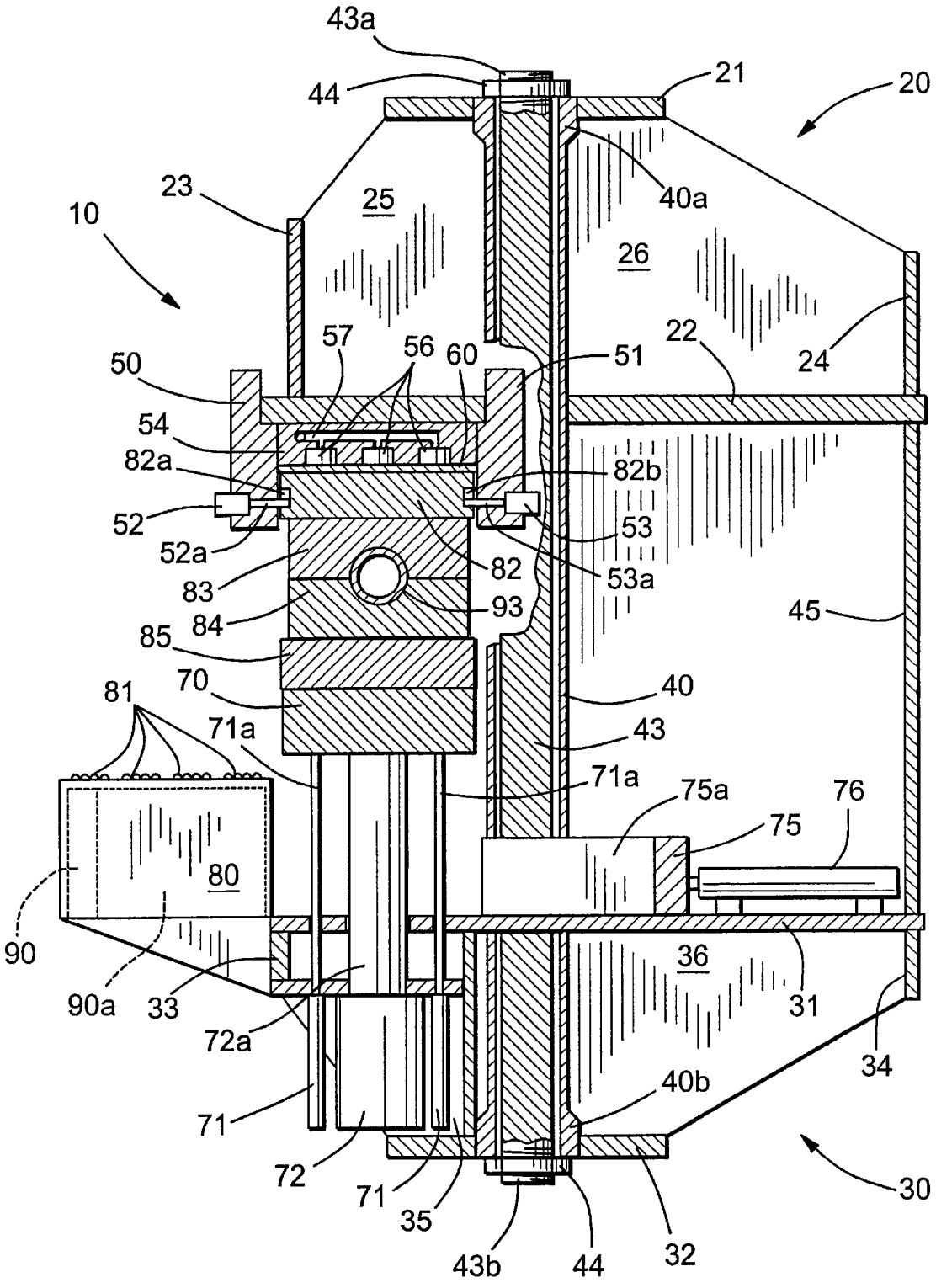
FIG. 9 is a sectional elevational view similar to FIG. 8 showing the crosshead and the hydroforming die after having been moved to the furthermost elevated position by the lift cylinders and the crush cylinders.

Next, the pistons 71*a* of the lift cylinders 71 and the pistons 72*a* of the crush cylinders 72 are actuated to elevate the lower die section 84, the lower die mounting plate 85, and the crosshead 70 upwardly relative to the upper die mounting plate 82 and the upper die section 83 to an uppermost position shown in FIG. 9. As mentioned above, the lift cylinders 71 are preferably relatively small in size so as to selectively effect relatively high velocity, low force exertion movement of the pistons 71*a*. As a result, the majority of the elevation of the lower die section 84, the lower die mounting plate 85, and the crosshead 70 can be performed relatively quickly, which advantageously reduces the overall cycle time of the hydroforming apparatus. As also mentioned above, the crush cylinders 72 are preferably relatively large in size so as to selectively effect relatively low velocity, high force exertion movement of the pistons 72*a*. Thus, during this initial elevation of the lower die section 84, the lower die mounting plate 85, and the crosshead 70, the pistons 72*a* of the crush cylinders 72 may follow slightly behind the pistons 71*a* of the lift cylinders 71. However, because the pistons 72*a* of the crush cylinders 72 bear no load during this upward movement, the amount of lag time required for the pistons 72*a* of the crush cylinders 72 to catch up with the pistons 71*a* of the lift cylinders 71 is minimal.

When the pistons 72*a* of the crush cylinders 72 do catch up, they engage and exert a relatively large amount of force against the lower surface of the crosshead 70. As a result, the lower die mounting plate 85 and the lower die 84 are urged upwardly against the upper die 83 and the upper die mounting plate 82 with a relatively large amount of force. Such force also urges the retainer plate 60 upwardly into engagement with the cylinder array 54, as shown in FIG. 9. During this movement, the pistons 56 are retracted within their respective cylinders 55. As mentioned above, the passageways 57 formed through the cylinder array 54 do not communicate with the source of pressurized fluid. Thus, only the force of gravity must be overcome to move the retainer plate 60 upwardly into engagement with the cylinder array 54, and to retract the pistons 56 within their respective cylinders 55. The relatively large force exerted by the crush cylinders 72 may cause portions of the workpiece 93 to be mechanically deformed by the upper and lower die sections 82 and 83, respectively.

Figure 10:
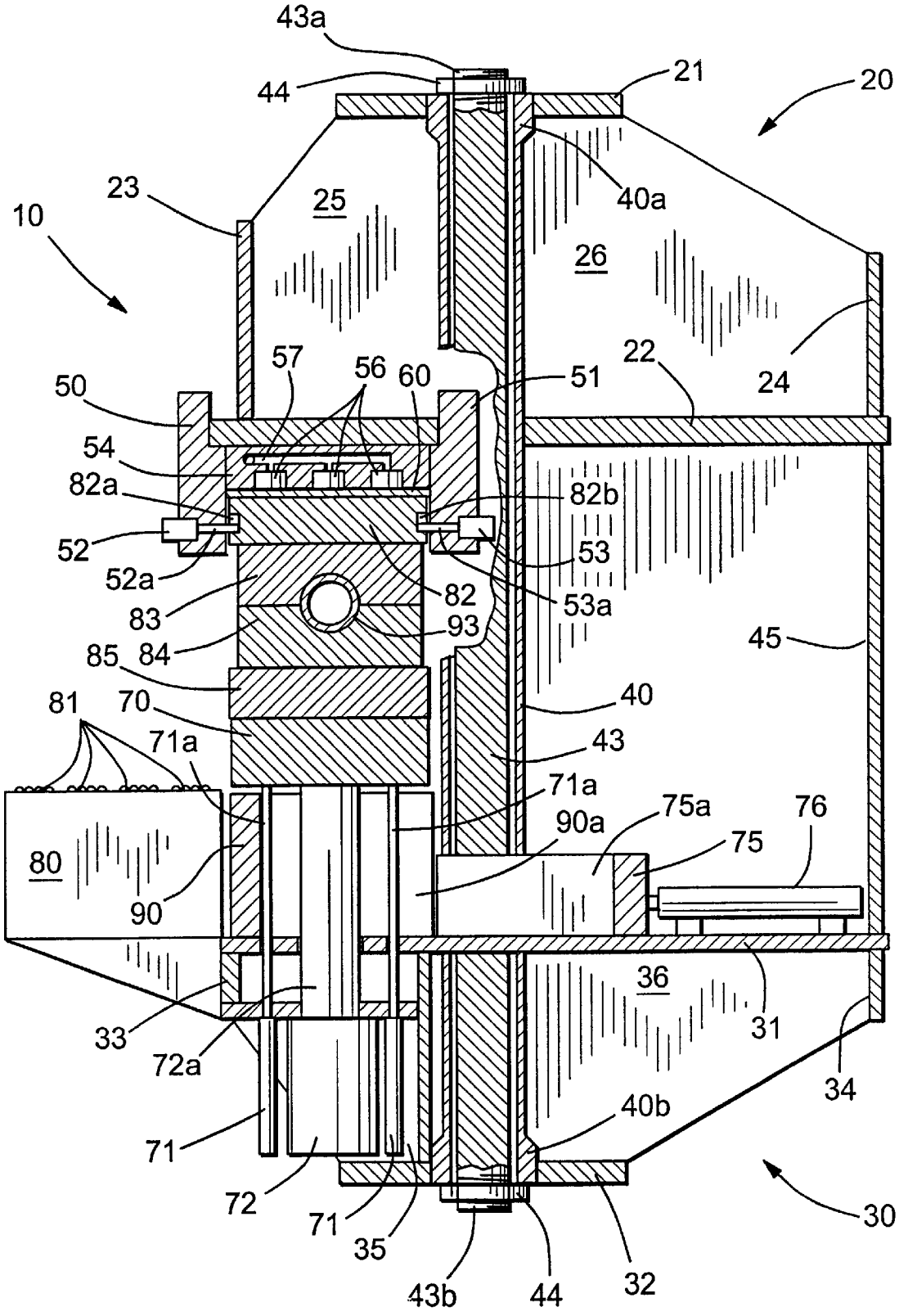
FIG. 10 is a sectional elevational view similar to FIG. 9 showing the hydroforming support block after having been moved to an extended position beneath the crosshead and the hydroforming die by the support block cylinders.

When the lower die section 84, the lower die mounting plate 85, and the crosshead 70 have been moved upwardly relative to the upper die mounting plate 82 and the upper die section 83 to the uppermost position shown in FIG. 9, the lower surface of the crosshead 70 is positioned slightly above the upper surface of the hydroforming support block 90 disposed within the hollow die transfer housing 80. Accordingly, the support block cylinders 91 can then be actuated to extend the support block 90 laterally beneath the crosshead 70, as shown in FIG. 10. As mentioned above, one or more slots 90*a* are formed in the support block 90. These slots 90*a* are provided to permit this lateral movement of the support block 90 to occur while the pistons 71*a* of the lift cylinders 71 and the pistons 72*a* of the crush cylinders 72 are extended. Such pistons 71*a* and 72*a* are received within the clearance provided by the slots 90*a* so that no interference with the support block 90 occurs.

Figure 11:
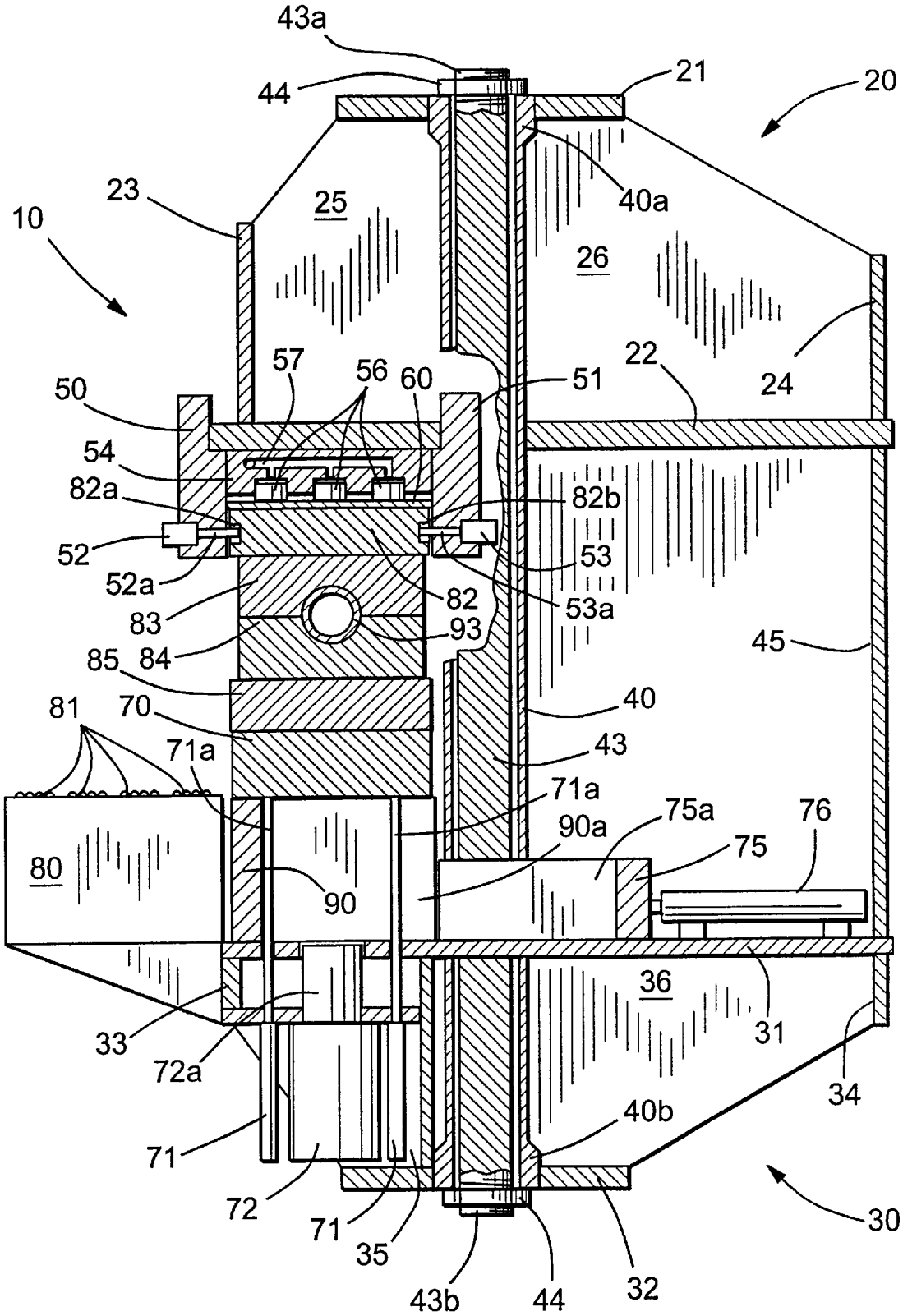
FIG. 11 is a sectional elevational view similar to FIG. 10 showing the pistons contained in the cylinder array after having been extended downwardly by pressurized fluid during the hydroforming operation.

Then, the pistons 71*a* of the lift cylinders 71 and the pistons 72*a* of the crush cylinders 72 are retracted such that the lower surface of the crosshead 70 is lowered onto the upper surface of the hydroforming support block 90, as shown in FIG. 11. As a result, the entire hydroforming die is positively supported on the hydroforming support block 90 and, therefore, the lower platen 30 of the hydroforming apparatus 10. Thereafter, the passageways 57 formed through the cylinder array 54 are placed in fluid communication with the source of pressurized fluid. The pressurized fluid causes the pistons 56 contained within the cylinder array 54 to be extend outwardly from their respective cylinders 55, exerting a relatively large downward force against the retainer plate and the upper die mounting plate 82.

In this manner, the hydroforming die is securely clamped together, allowing the hydroforming operation to occur. As mentioned above, conventional end feed cylinders (not shown) engage the ends of the workpiece 93 that protrude from the sides of the hydroforming die. Such end feed cylinders seal against the ends of the workpiece 93 and provide a mechanism for supplying pressurized fluid to the interior of the workpiece 93. In a manner that is well known in the art, such pressurized fluid causes the workpiece 93 to deform or expand outwardly into conformance with the die cavity defined by the upper and lower die sections 82 and 83, respectively. Because of the relatively large downward force exerted by the pistons 56 against the retainer plate and the upper die mounting plate 82, and further because the lower die mounting plate 85 and the crosshead 70 are positively supported on the hydroforming support block 90 and the lower platen 30 of the hydroforming apparatus 10, relative movement between the upper die section 83 and the lower die section 84 during the pressurization of the workpiece 93 is prevented.

It will be appreciated that during the hydroforming operation, relatively large reaction forces are generated against the front ends of the upper and lower platens 20 and 30 of the hydroforming apparatus 10. When viewing FIG. 11, it can be seen that such reaction forces tend to tilt the upper platen 20 in a clockwise direction about the tie rods 43 relative to the lower platen 30. Such reaction forces are, in large measure, absorbed by the backing plate 45 that extends between the rear ends of the upper and lower platens 20 and 30. From FIG. 11, it can be seen that the lateral distance from the centers of the tie rods 43 forwardly to the center of the hydroforming die (which is where the reaction forces are generated) is much smaller that the lateral distance from the centers of the tie rods 43 rearwardly to the backing plate 45 (which is where the reaction forces are absorbed). The mechanical advantage provided by the difference in distances allows the size of the backing plate 45 to be maintained relatively small. Thus, the overall size, weight, and expense of the hydroforming apparatus 10 is minimized.

Also, as mentioned above, the compression tubes 40 are pre-stressed with compressive forces by the tie rods 43 and the nuts 44. Because of the engagement of the upper plate 20 with the backing plate, the reaction forces generated during the hydroforming operation tend to generate tension forces in the compression tubes 40. Preferably, the pre-stressed compressive forces generated in the compression tubes 40 are predetermined to be approximately equal to or slightly greater than the maximum amount of such tension forces generated during the hydroforming operation. As a result, such tension forces tend to counteract the pre-stressed compressive forces in the compression tubes 40, as opposed to generating net tension forces in the compression tubes 40.

At the conclusion of the hydroforming of the workpiece 93, the passageways 57 formed through the cylinder array 54 are removed from fluid communication with the source of pressurized fluid, thereby releasing the relatively large clamping forces exerted against the hydroforming die. At the same time, the pistons 71*a* of the lift cylinders 71 are extended to elevate the crosshead 70 above the spacer block 90, as shown in FIG. 10. The support block cylinders 91 can then be actuated to retract the support block 90 within the hydroforming support block 90, as shown in FIG. 9. Lastly, the pistons 71*a* of the lift cylinders 71 are retracted to lower the crosshead 70, the lower die mounting plate 85, and the lower die section 84 downwardly relative to the upper die section 83 and the upper die mounting plate 82, as shown in FIG. 8. The hydroformed workpiece 93 can then be removed to complete the cycle of the hydroforming operation.

As described above, the installation of the hydroforming die and the cycle of the hydroforming operation entails a series of sequential operations of the various components of the hydroforming apparatus 10. To accomplish these sequential operations quickly and safely, a plurality of sensors (not shown) are preferably provided on the hydroforming apparatus 10. Such sensors are conventional in the art and are adapted to generate electrical signals that are representative of various operating conditions of the hydroforming apparatus 10. The sensed operating conditions can include position sensors to insure that the moving components of the hydroforming apparatus 10 actually achieve their desired positions before proceeding with the next step in the cycle of the hydroforming operation, pressure sensors to insure that proper pressurization is achieved within the cylinder array 54, and the like. The signals from such sensors can be fed to one or more electronic controllers (not shown) for actuating the various components of the hydroforming apparatus 10. The electronic controllers are conventional in the art and can be programmed to monitor the signals from the various sensors and, in response thereto, cause the sequential operations set forth above to be performed. The structure and operation of the sensors and the electronic controllers is within the knowledge of a person having ordinary skill in the art.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for performing a hydroforming operation comprising:

an upper platen having a first end and a second end;

a lower platen having a first end and a second end;

a member extending between said upper and lower platens, said member extending between said first and second ends of said upper platen and between said first and second ends of said lower platen;

a hydroforming die disposed between said first end of said upper platen and said first end of said lower platen; and a backing plate extending between said second end of said upper platen and said second end of said lower platen.

2. The apparatus defined in claim 1 wherein said member is normally maintained in compression.

3. The apparatus defined in claim 1 wherein said member is a tube having a tie rod extending therethrough, said tie rod having end portions that engage end portions of said tube to normally maintain said tube in compression.

4. The apparatus defined in claim 1 wherein said hydroforming die includes an upper die section that is supported for relative movement on an upper die clamping assembly connected to said upper platen.

5. The apparatus defined in claim 4 wherein said upper die clamping assembly further includes a passageway for receiving pressurized fluid and for exerting forces on said upper die section during the hydroforming operation.

6. The apparatus defined in claim 4 wherein said upper die clamping assembly further includes a cylinder array for receiving pressurized fluid and for exerting forces on said upper die section during the hydroforming operation.

7. The apparatus defined in claim 1 wherein said hydroforming die includes a lower die section that is supported for relative movement on said lower platen.

8. The apparatus defined in claim 7 further including a support block that is movable between an extended position, wherein said support block is disposed between said lower die section and said lower platen during the hydroforming operation, and a retracted position, wherein said support block is not disposed between said lower die section and said lower platen.

9. The apparatus defined in claim 8 further including a cylinder for selectively moving said lower die section relative to said lower platen between a first position, wherein said support block can be moved from said retracted position to said extended position, and a second position, wherein said lower die section is supported on said support block during the hydroforming operation.

10. An apparatus for performing a hydroforming operation comprising:

an upper platen having a first end and a second end;

a lower platen having a first end and a second end;

a member extending between said upper and lower platens, said member extending between said first and second ends of said upper platen and between said first and second ends of said lower platen;

a hydroforming die disposed between said first end of said upper platen and said first end of said lower platen, said hydroforming die including an upper die section that is supported for relative movement on an upper die clamping assembly connected to said upper platen, said upper die clamping assembly including a passageway for receiving pressurized fluid and for exerting forces on said upper die section during the hydroforming operation; and a backing plate extending between said second end of said upper platen and said second end of said lower platen.

11. The apparatus defined in claim 10 wherein said member is normally maintained in compression.

12. The apparatus defined in claim 10 wherein said member is a tube having a tie rod extending therethrough, said tie rod having end portions that engage end portions of said tube to normally maintain said tube in compression.

13. The apparatus defined in claim 10 wherein said upper die clamping assembly further includes a cylinder array for receiving pressurized fluid and for exerting forces on said upper die section during the hydroforming operation.

14. The apparatus defined in claim 10 wherein said hydroforming die includes a lower die section that is supported for relative movement on said lower platen.

15. The apparatus defined in claim 14 further including a support block that is movable between an extended position, wherein said support block is disposed between said lower die section and said lower platen during the hydroforming operation, and a retracted position, wherein said support block is not disposed between said lower die section and said lower platen.

16. The apparatus defined in claim 15 further including a cylinder for selectively moving said lower die section relative to said lower platen between a first position, wherein said support block can be moved from said retracted position to said extended position, and a second position, wherein said lower die section is supported on said support block during the hydroforming operation.

17. An apparatus for performing a hydroforming operation comprising:

an upper platen having a first end and a second end;

a lower platen having a first end and a second end;

a member extending between said upper and lower platens, said member extending between said first and second ends of said upper platen and between said first and second ends of said lower platen;

a hydroforming die disposed between said first end of said upper platen and said first end of said lower platen, said hydroforming die including an upper die section that is supported for relative movement on an upper die clamping assembly connected to said upper platen, said upper die clamping assembly including a cylinder array for receiving pressurized fluid and for exerting forces on said upper die section during the hydroforming operation; and a backing plate extending between said second end of said upper platen and said second end of said lower platen.

18. The apparatus defined in claim 17 wherein said member is normally maintained in compression.

19. The apparatus defined in claim 17 wherein said member is a tube having a tie rod extending therethrough, said tie rod having end portions that engage end portions of said tube to normally maintain said tube in compression.

20. The apparatus defined in claim 17 wherein said upper die clamping assembly further includes a passageway for receiving pressurized fluid and for exerting forces on said upper die section during the hydroforming operation.

21. The apparatus defined in claim 17 wherein said hydroforming die includes a lower die section that is supported for relative movement on said lower platen.

22. The apparatus defined in claim 21 further including a support block that is movable between an extended position, wherein said support block is disposed between said lower die section and said lower platen during the hydroforming operation, and a retracted position, wherein said support block is not disposed between said lower die section and said lower platen.

23. The apparatus defined in claim 22 further including a cylinder for selectively moving said lower die section relative to said lower platen between a first position, wherein said support block can be moved from said retracted position to said extended position, and a second position, wherein said lower die section is supported on said support block during the hydroforming operation.

24. An apparatus for performing a hydroforming operation comprising:

an upper platen having a first end and a second end;

a lower platen having a first end and a second end;

a member extending between said upper and lower platens, said member extending between said first and second ends of said upper platen and between said first and second ends of said lower platen;

a hydroforming die disposed between said first end of said upper platen and said first end of said lower platen, said hydroforming die including a lower die section that is supported for relative movement on said lower platen;

a support block that is movable between an extended position, wherein said support block is disposed between said lower die section and said lower platen during the hydroforming operation, and a retracted position, wherein said support block is not disposed between said lower die section and said lower platen; and a backing plate extending between said second end of said upper platen and said second end of said lower platen.

25. The apparatus defined in claim 24 wherein said member is normally maintained in compression.

26. The apparatus defined in claim 24 wherein said member is a tube having a tie rod extending therethrough, said tie rod having end portions that engage end portions of said tube to normally maintain said tube in compression.

27. The apparatus defined in claim 24 wherein said hydroforming die includes an upper die section that is supported for relative movement on an upper die clamping assembly connected to said upper platen.

28. The apparatus defined in claim 27 wherein said upper die clamping assembly further includes a passageway for receiving pressurized fluid and for exerting forces on said upper die section during the hydroforming operation.

29. The apparatus defined in claim 24 wherein said upper die clamping assembly further includes a cylinder array for receiving pressurized fluid and for exerting forces on said upper die section during the hydroforming operation.

30. The apparatus defined in claim 24 further including a cylinder for selectively moving said lower die section relative to said lower platen between a first position, wherein said support block can be moved from said retracted position to said extended position, and a second position, wherein said lower die section is supported on said support block during the hydroforming operation.

* * * * *